US010493347B2

(12) United States Patent
Halpin

(10) Patent No.: US 10,493,347 B2
(45) Date of Patent: Dec. 3, 2019

(54) PUTTING TARGET

(71) Applicant: Sean Halpin, Rochester Hills, MI (US)

(72) Inventor: Sean Halpin, Rochester Hills, MI (US)

( * ) Notice: Subject to any disclaimer, the term of this patent is extended or adjusted under 35 U.S.C. 154(b) by 0 days.

(21) Appl. No.: 15/491,061

(22) Filed: Apr. 19, 2017

(65) Prior Publication Data

US 2018/0304140 A1 Oct. 25, 2018

(51) Int. Cl.

| | |
|---|---|
| ***A63B 69/36*** | (2006.01) |
| ***A63B 57/40*** | (2015.01) |
| ***A63B 67/02*** | (2006.01) |

(52) U.S. Cl.

CPC ..... *A63B 69/3676* (2013.01); *A63B 57/40* (2015.10); *A63B 2067/025* (2013.01)

(58) Field of Classification Search

CPC ..... A63B 69/3676; A63B 57/40; A63B 2067/025

See application file for complete search history.

(56) References Cited

U.S. PATENT DOCUMENTS

| | | | | |
|---|---|---|---|---|
| D80,142 | S | 12/1929 | Schmitz | |
| 1,798,140 | A | 3/1931 | Byers | |
| D164,166 | S | 8/1951 | Griswold | |
| 2,917,312 | A | 12/1959 | Brown | |
| D245,274 | S | 8/1977 | Jarrett | |
| 4,573,686 | A * | 3/1986 | Nakamats | A63B 63/00 473/184 |
| 4,725,063 | A * | 2/1988 | Hoyt, Jr. | A63B 69/3676 473/184 |
| 5,165,690 | A * | 11/1992 | Kelley, Jr. | A63B 63/007 472/88 |
| 5,201,521 | A | 4/1993 | Healy | |
| D353,433 | S * | 12/1994 | Erdoes | D21/792 |
| D385,610 | S | 10/1997 | McDonald | |
| D400,631 | S | 11/1998 | Moore | |
| D409,704 | S | 5/1999 | Nunes | |
| D519,181 | S | 4/2006 | Jones | |
| D568,432 | S | 5/2008 | Rubino | |
| 8,177,233 | B2 | 5/2012 | Grayson | |
| D673,635 | S | 1/2013 | Cameron | |
| D727,448 | S | 4/2015 | Greenwood | |
| 9,327,176 | B1 * | 5/2016 | Goserud | A63B 69/3676 |
| 2002/0045488 | A1 | 4/2002 | Patterson | |
| 2009/0176591 | A1 | 7/2009 | Kershaw | |
| 2011/0124428 | A1 * | 5/2011 | O'Loughlin | A63B 57/357 473/196 |

* cited by examiner

*Primary Examiner* — Michael D Dennis
(74) *Attorney, Agent, or Firm* — Lorenz & Kopf, LLP

(57) ABSTRACT

A putting target is disclosed which visually replicates a golf hole and reliably returns a golf ball to the putting location. The putting target includes a lip, a ramp and an angled wall segment. The ramp includes a concaved surface defined by a quadratic spline in each of a longitudinal (x-z) plane and a lateral (y-z) plane and a rim circumscribing the concaved face. An angled wall segment extends from the rim and terminates at a bottom edge for supporting the ramp at an inclined orientation with respect to the putting surface. An image is applied to at least a portion of the ramp and provides a perspective view of a golf hole along a predetermined line of sight.

18 Claims, 5 Drawing Sheets

PUTTING TARGET

TECHNICAL FIELD

The present disclosure relates to a golf putting practice device and is more particularly concerned with a putting target which is visually configured replicate a golf hole and returns a golf ball to the putting location from where it was putted.

BACKGROUND

This section provides background information related to the present disclosure which is not necessarily prior art.

Various golf putting practice devices are on the market, which return a golf ball towards a putting location. One class of devices uses a mechanism to propel the ball back towards the putting location. These mechanisms can be complicated, expensive and unreliable. Another class of devices uses gravitation force to direct the ball back toward the putting location. With these devices, a golf ball is putted up an inclined ramp onto a flat surface having a hole. If the ball goes in the hole, it is discharged from a chute or channel back toward the putting location. If the ball does not go in the hole it may roll down the inclined surface toward the putting location or may remain on the flat surface where it must be retrieved by the golfer. With devices of this type, the angle of the inclined ramp can significantly alter a golfer's putting stroke such that it is unproductive for putting practice.

Accordingly, it is desirable to provide a simple putting target that is productive for putting practice and effective for repeatedly returning the golf ball to the putting location. In addition, it is desirable to provide a simple putting target that visually replicates an actual golf hole from the putting location. Other desirable features and characteristics of the present invention will become apparent from the subsequent detailed description and the appended claims, taken in conjunction with the accompanying drawings and the foregoing technical field and background.

SUMMARY

An apparatus is provided for a putting target which returns a golf ball to a putting location and may be configured to visually replicate a golf hole. In one embodiment, the putting target configured to rest on a putting surface. A target body includes a ramp having a concaved surface, a rim circumscribing the concaved surface and a wall segment extending from the rim and terminating at a bottom edge for supporting the ramp at an inclined orientation with respect to the putting surface. The target body is formed with a first plastic material. A lip establishes a leading edge of the target body and transitions to the concaved surface formed on the ramp. The lip being formed with a second plastic material. A hardness of the first plastic material is greater than a hardness of the second plastic material.

In another embodiment, the putting target includes a target body configured to rest on a putting surface. The target body has a ramp including a concaved surface, a rim circumscribing the concaved face and a wall segment extending from the rim and terminating at a bottom edge for supporting the ramp at an inclined orientation with respect to the putting surface. An image is applied to at least a portion of the ramp to provide a perspective view of a golf hole along a predetermined line of sight.

In yet another embodiment, the putting target includes a target body formed with a first plastic material and configured to rest on a putting surface. The target body includes a ramp having a concaved surface defined by at least one quadratic spline in each of a longitudinal (x-z) plane and a lateral (y-z) plane of the ramp, a rim circumscribing the concaved surface, and an angled wall segment extending from the rim and terminating at a bottom edge for supporting the ramp at an inclined orientation with respect to the putting surface. A lip establishes a leading edge of the target body and transitions to the concaved surface formed on the ramp. The lip is formed with a second plastic material. A hardness of the first plastic material is greater than a hardness of the second plastic material.

DESCRIPTION OF THE DRAWINGS

The exemplary embodiments will hereinafter be described in conjunction with the following drawing figures, wherein like numerals denote like elements.

DETAILED DESCRIPTION

Figure 1:
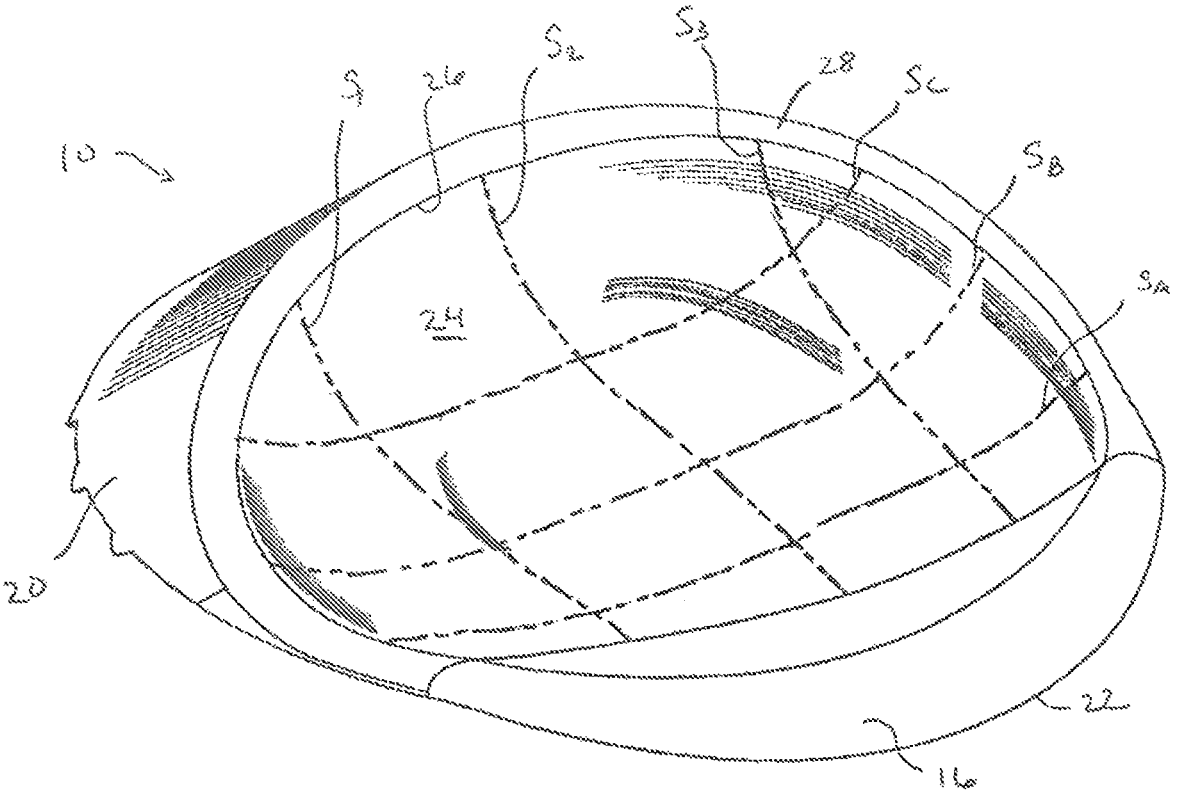
FIG. 1 is a top perspective view of a putting target in accordance with the present disclosure.

The following detailed description is merely exemplary in nature and is not intended to limit the invention disclosed herein or the application and uses of the invention disclosed herein. Furthermore, there is no intention to be bound by any principle or theory, whether expressed or implied, presented in the preceding technical field, background, summary or the following detailed description, unless explicitly recited as claimed subject matter.

In accordance with the present disclosure, a putting target 10 is provided which may be configured to visually replicate a golf hole and reliably returns a golf ball to the putting location from where it was putted. With reference to the drawings, the putting target 10 includes a target body 12 configured to rest on a putting surface 14. The target body has a lip 16, a ramp 18 and a wall segment 20 supporting the ramp 18 at an inclined orientation with respect to the putting surface 14.

The lip 16 provides a modest incline (about 5°) from a leading edge 22 at the putting surface 14 to the ramp 18. The lip 16 is preferably formed with a soft or pliable plastic material (such as rubber, silicon rubber, soft polyurethane or other thermoplastic elastomers) having a durometer or harness in a range of 30-100 on the Shore A scale. The Shore A scale (ASTM D2240 type A scale) is typically used for softer plastics.

The ramp 18 transitions from the lip 16 and provides a non-linear, concaved surface 24 for stopping the roll of a golf ball, then re-directing it back towards the putting location. The concaved surface 24 provides a transition from the lip 16 to the rearward edge 26 of the ramp 18 opposite the leading edge 22 where the ramp 18 forms a relatively steep angle (about 60°) relative to the putting surface 14 so that a golf ball will have sufficient energy to return to the putting location. A rim 28 circumscribes the concaved surface 24 and terminates at the lip 16.

A wall segment 20 extends from the rim 28 and terminates at a bottom edge 32 of the target body 12. The wall segment 20 preferably forms an included angle (θ) with the putting surface 14 in a range between 30° and 66° to provide an angled wall segment. Ribs 34 are formed in the bottom of the target body 12 and extend between a bottom surface 36 of the ramp 18 and an inner face 38 of the wall segment 20. Spikes 40 extend from the bottom edge 32 of the wall segment 20 and spikes 44 extend from a bottom edge 42 of the ribs 34 for securely positioning the putting target 10 on the putting surface 14. Bosses 50 may also be formed in the ribs 34 and are configured to receive a nail or pin (not shown) to stick into the putting surface 14 (e.g., carpet, artificial turf or natural grass) for securing the putting target 10.

Figure 7:
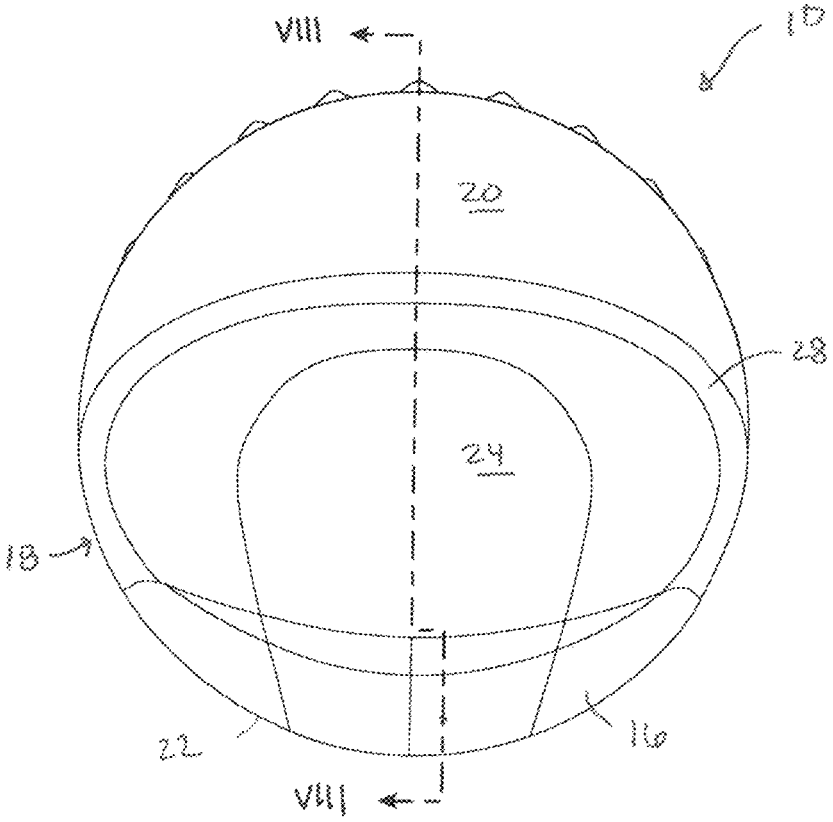
FIG. 7 is a top view of the putting target.

Good directional return of a golf ball from the putting target 10 may be realized when the concaved surface 24 is defined by a quadratic spline $S_2$ in a longitudinal (x, z) plane and a quadratic spline $S_B$ in a lateral (y, z) plane of the ramp 18. The concaved surface 24 may be defined a plurality of by quadratic splines lying in associated planes parallel to the longitudinal and/or lateral planes. For example, as shown in FIG. 7, the concaved surface 24 is defined by multiple longitudinal splines $S_1$, $S_2$, $S_3$ and lateral splines $S_A$, $S_B$, $S_c$.

A quadratic spline is a line segment having one or more pieces defined by a quadratic function (eqns. 1 and 2) as follows:

$$f(x,z)=A_qx^2+B_qz^2+C_qxz+D_qx+E_qz+F_q \quad (1)$$

$$f(y,z)=G_qy^2+Hz^2+I_qyz+J_qy+K_qz+L_q \quad (2)$$

wherein $A_q$-$L_q$ are constants. If $A_q$-$C_q$ and $G_q$-$I_q$ are zero then the quadratic function may be reduced to a linear function. In other words, some portions of the line segment may be curved, while other portions of the line segment may be straight. The slope of the line segment at the point where adjacent pieces connect is equal, thus providing a high degree of smoothness. The directional return of the concaved surface is further enhanced when the curvature or concavity $r_c$ of the line segment (i.e., the second derivative of any quadratic function) is always greater than the radius $r_{GB}$ of a golf ball GB. While quadratic splines are suitable for defining the concave surface, one skilled in the art will recognize that the concaved surface may be defined by one or more splines including higher order polynomial functions such as a cubic spline.

Figure 2:
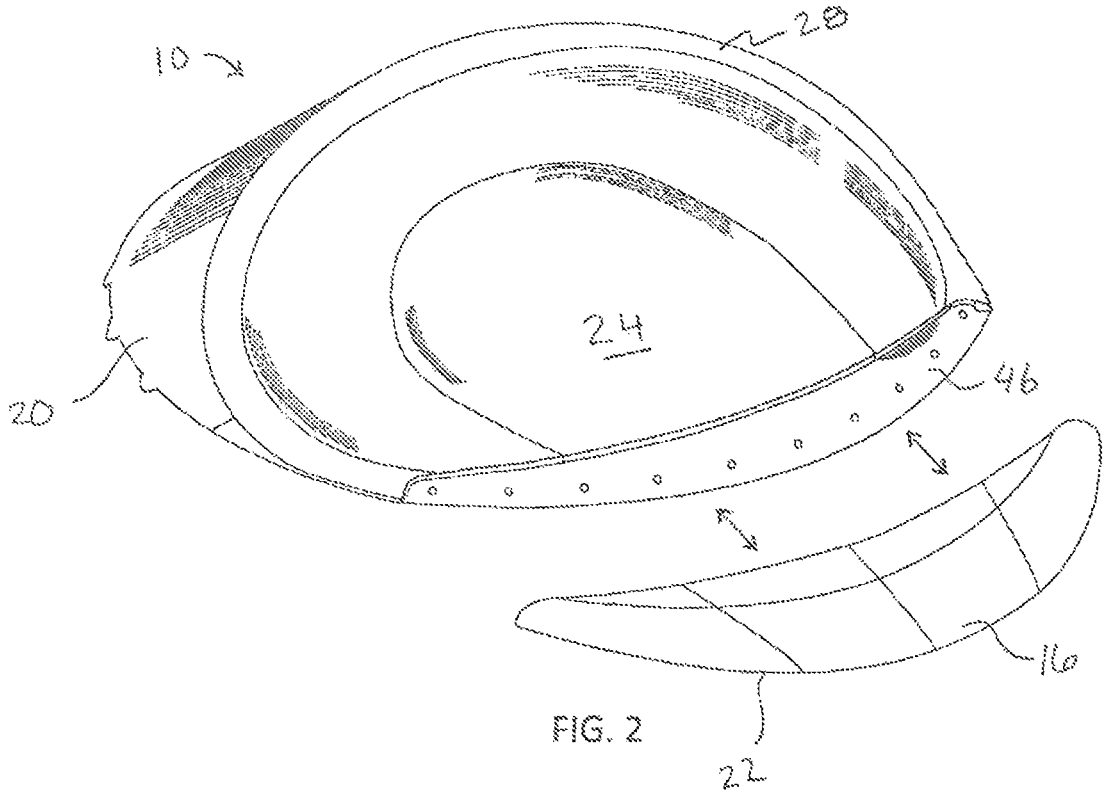
FIG. 2 is a view like FIG. 1 showing a lip and a concaved ramp and an overlay of the putting target in an expanded view.

The ramp 18, wall segment 20, ribs 34, spikes 40, 44 and bosses 50 are preferably injection molding as a single piece using a relatively hard plastic material compared to the lip 18 (such as hard polyurethane, polypropylene, polycarbonate, polystyrene, ABS, or nylon) having a durometer or hardness in a range of 70-100 or higher on the Shore D scale. The Shore D scale (ASTM D2240 type D scale) is typically used for harder plastics. The lip 16 may be formed onto a flange section 46 (FIG. 2) of the ramp 18 using an insert or multi-shot process to securely connect the lip 16 to the ramp 18.

Figure 5B:
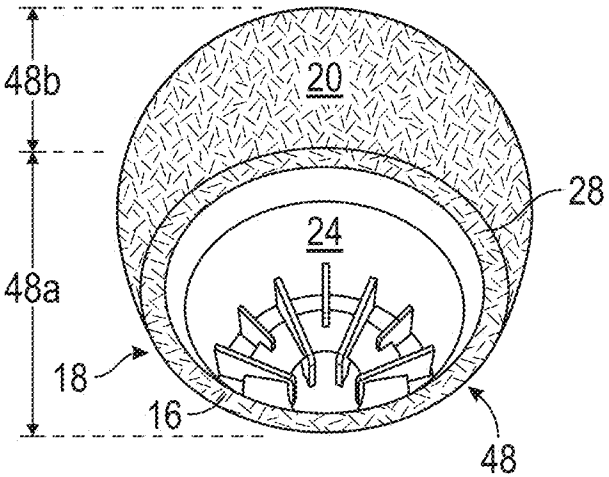
FIG. 5B is a top view of the putting target with the overlay applied.
Figure 5A:
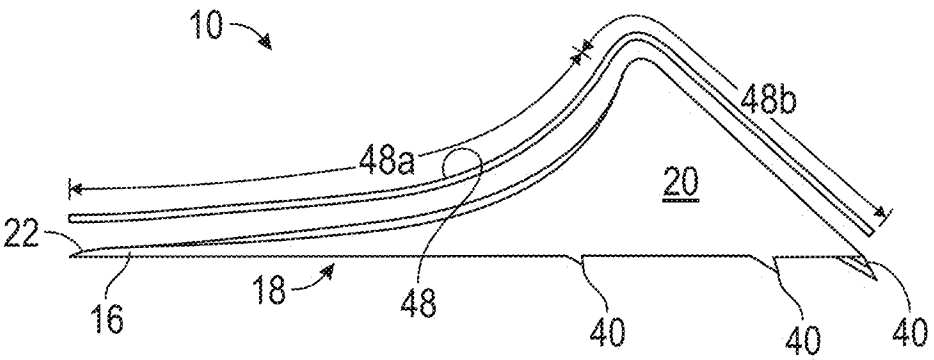
FIG. 5A is a side view of the putting target showing the overlay expanded from the ramp.
Figure 3:
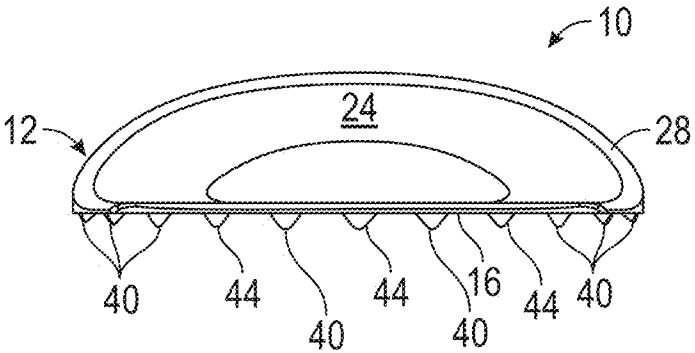
FIG. 3 is a front view of the putting target.
Figure 4:
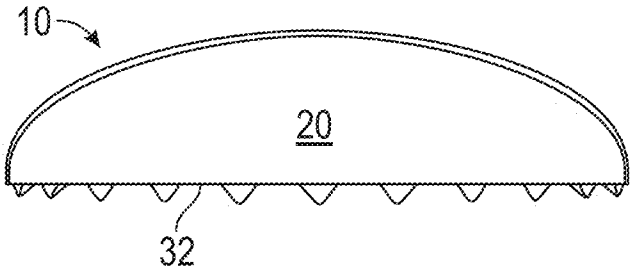
FIG. 4 is a rear view of the putting target.
Figure 6:
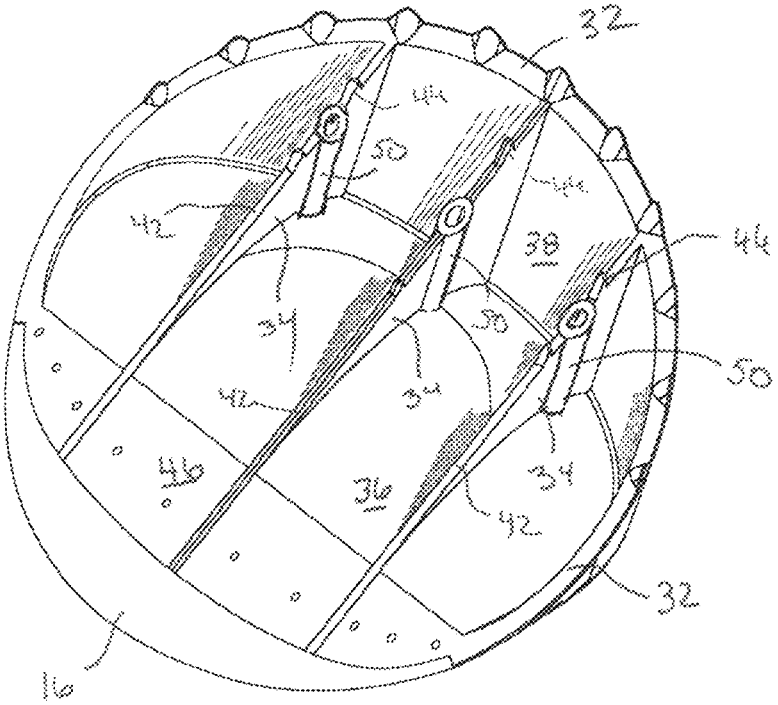
FIG. 6 is a bottom perspective view of the putting target.
Figure 13:
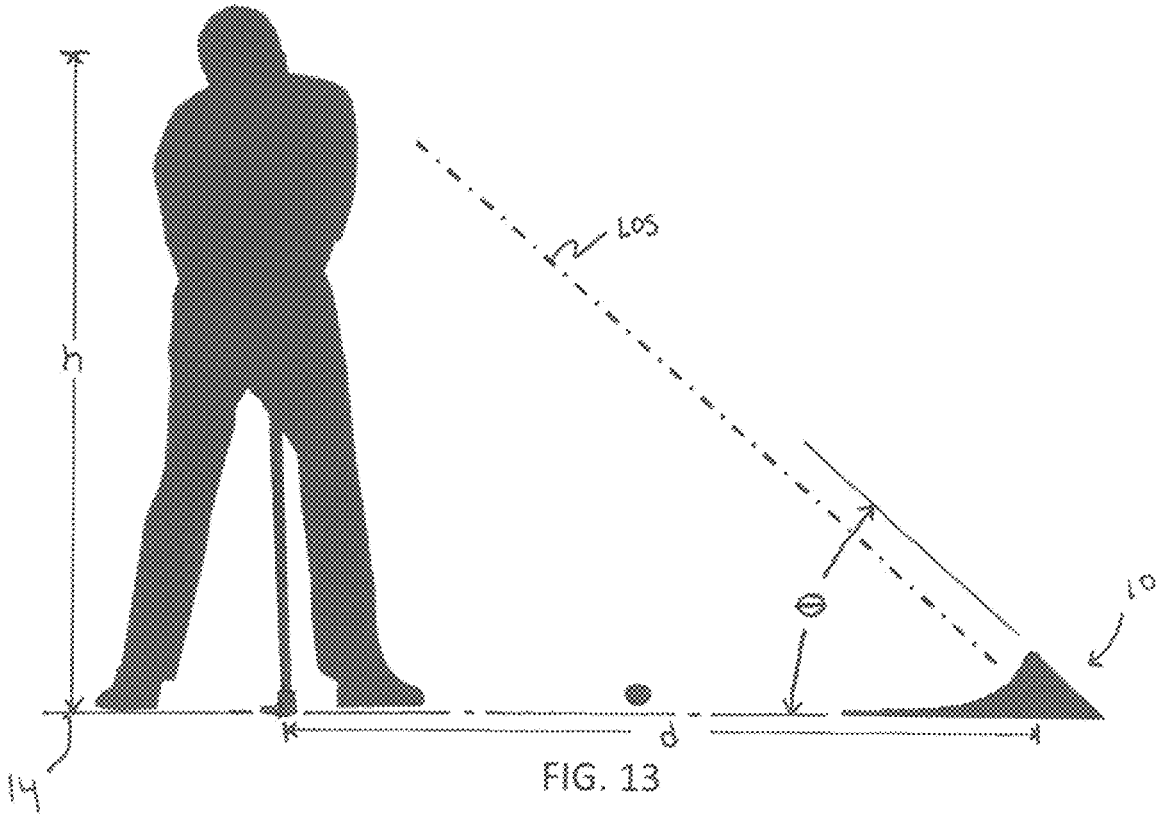
FIG. 13 is a simplified side view showing the putting target in use.
Figure 14:
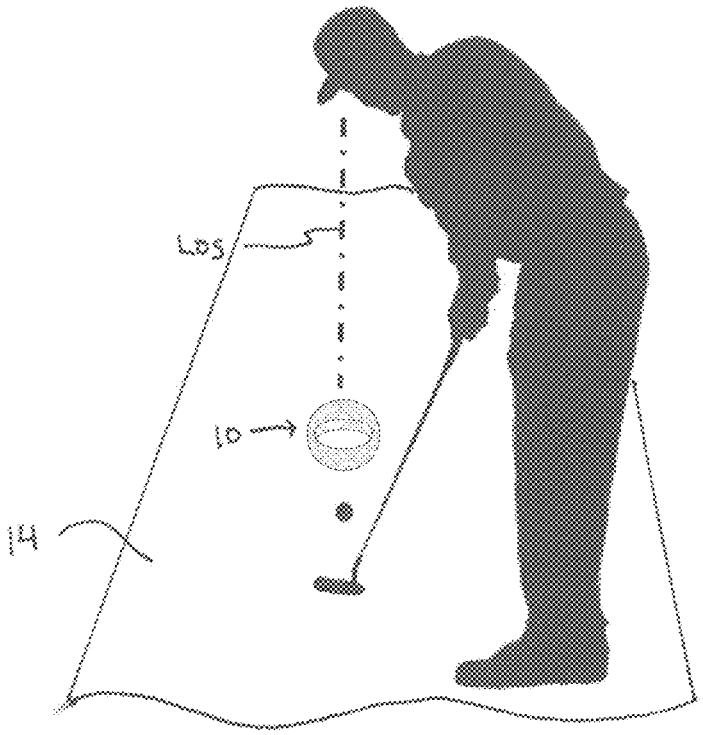
FIG. 14 is a simplified front view showing the putting target in use.

The putting target 10 may be configured to visually replicate a golf hole from the view of a golfer in a putting stance (FIGS. 13-14). In this regard, an overlay 48, which provides a perspective view of a golf hole along a predetermined line of sight, is applied to the target body 12. For example, the overlay 48 may be geometrically cut and applied to the concaved surface to replicate a golf cup along a predetermined line of slight to closely approximate a hole for a given distance. The overlay 48 may be a decal or adhesive sticker (FIGS. 2 and 5A) or may be molded in or printed on the concaved surface 24. A cup portion 48*a* of the overlay 48 includes an image of the cup and some adjacent green and covers the lip 16, the ramp 18 including the concaved surface 24 and the rim 28. A greens portion 48*b* includes an image of the green only and covers the wall segment 20 (FIGS. 5A and 5B).

Figure 8:
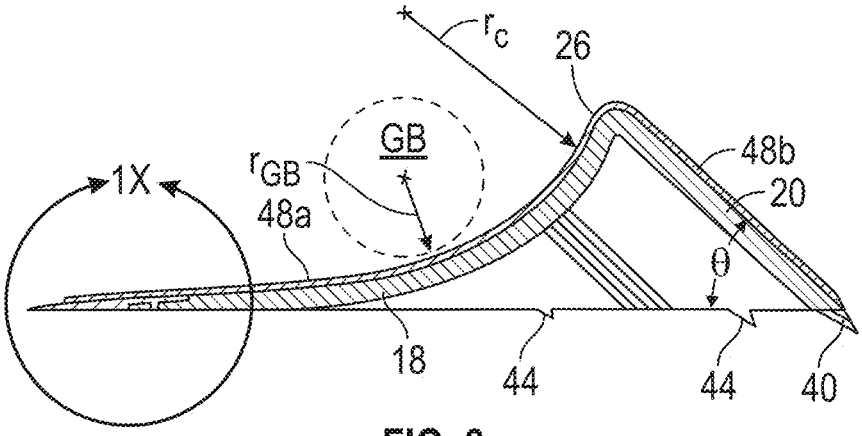
FIG. 8 is a cross-section taken through line VIII-VIII shown in FIG. 7.
Figure 9:
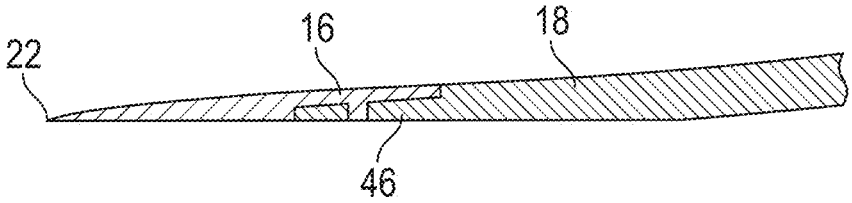
FIG. 9 is a detail at IX of FIG. 8 showing the lip transitioning to the ramp.

Furthermore, a line of sight of the golfer to the putting target should be parallel to back portion of the angled wall 20 on the target body 12. In other words, the included angle (formed by the angled wall of the target body 12) defines the preferred putting distance for a given putting target 10 (FIGS. 8 and 13). A putting target 10 may be configured for a specific putting distance by changing the included angles and the image overlay. As shown in FIG. 13, the included angle (θ) is preferably configured to be parallel to the line of sight from the golfer to the putting target.

Figure 10:
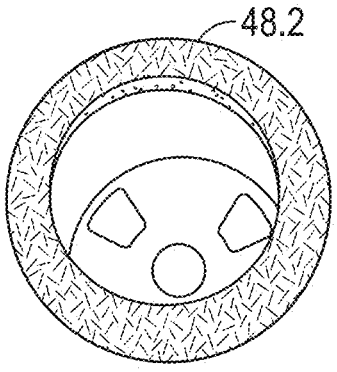
FIG. 10 is a perspective image illustrating a golf hole from about 2 feet.
Figure 11:
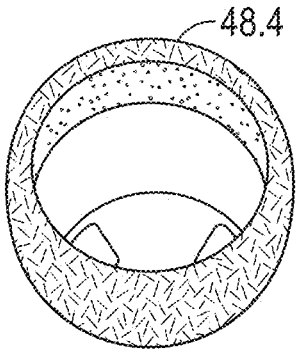
FIG. 11 is a perspective image illustrating a golf hole from about 4 feet.
Figure 12:
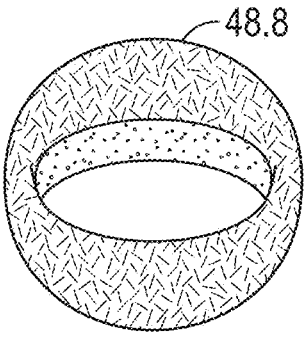
FIG. 12 is a perspective image illustrating a golf hole from about 8 feet.

For example, a putting target having overlay 48.2 and an included angle of 66° would properly position the eyes of an average height golfer (h) in a putting position at a putting distance (d) in the range of 1.8-2.2 feet. FIG. 10 shows an exemplary overlay 48.2 of a golf hole at a distance of approximately 2 ft. A putting target having overlay 48.4 and an included angle of 48° would position the eyes of an average height golfer (h) in a putting position at a putting distance (d) in the range of 3.5-4.6 feet. FIG. 11 shows an exemplary overlay 48.4 of a golf hole at a distance of approximately 4 ft. A putting target having overlay 48.8 and an included angle of 30° would position the eyes of an average height golfer (h) in a putting position at a putting distance (d) in the range of 6.9-8.7 feet. FIG. 12 shows an exemplary overlay 48.8 of a golf hole at a distance of approximately 8 ft.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the disclosure in any way. Rather, the foregoing detailed description will provide those skilled in the art with a convenient road map for implementing the exemplary embodiment or exemplary embodiments. Various changes can be made in the function and arrangement of elements without departing from the scope of the disclosure as set forth in the appended claims and the legal equivalents thereof.

What is claimed is:

1. A putting target comprising:

a target body configured to rest on a putting surface, the target body having a ramp including a concaved surface, a rim circumscribing the concaved surface and an angled wall segment forming an included angle with the putting surface, the angled wall segment extending from the rim and terminating at a bottom edge for supporting the ramp at an inclined orientation with respect to the putting surface; and an image applied to at least a portion of the ramp, the image including an ellipse visually replicating a golf hole at a predetermined putting distance from the target body along a predetermined line of sight which intersects the putting surface at the included angle;

wherein the concaved surface is defined by at least one quadratic spline in each of a longitudinal (x-z) plane and a lateral (y-z) plane of the ramp.

2. The putting target according to claim 1, wherein the included angle is in a range between 30° and 66°.

3. The putting target according to claim 1, wherein the concave surface has a minimum curvature radius that is greater than a golf ball radius.

4. The putting target according to claim 1, wherein the concaved surface is defined by a plurality of quadratic splines in an associated plane parallel to the longitudinal plane and the lateral plane of the ramp.

5. The putting target according to claim 1 further comprising a lip establishing a leading edge of the target body and transitioning to the concaved surface formed on the ramp.

6. The putting target according to claim 1 further comprising at least one rib extending between the ramp and the wall segment beneath the concaved surface.

7. The putting target according to claim 6 further comprising a plurality of spikes extending from at least one of the bottom edge of the wall segment or a bottom edge of the rib.

8. A putting target comprising:

a target body formed with a first plastic material and configured to rest on a putting surface, the target body having a ramp including a flange transitioning to a concaved surface, a rim circumscribing the concaved surface and a wall segment extending from the rim and terminating at a bottom edge for supporting the ramp at an inclined orientation with respect to the putting surface; and a lip formed over the flange establishing a leading edge of the target body and transitioning to the concaved surface formed on the ramp, the lip being formed with a second plastic material;

wherein a hardness of the first plastic material is greater than a hardness of the second plastic material.

9. The putting target according to claim 8 wherein the first plastic material has a Shore D harness in a range between 70 and 100 and the second plastic material has a Shore A hardness in a range between 30 and 100.

10. The putting target according to claim 8 wherein the wall segment comprises an angled wall segment.

11. The putting target according to claim 10, wherein the angled wall segment forms an included angle in a range between 30° and 66°.

12. The putting target according to claim 8, wherein the concave surface has a minimum curvature radius that is greater than a golf ball radius.

13. The putting target according to claim 8, wherein the concaved surface is defined by at least one quadratic spline in each of a longitudinal (x-z) plane and a lateral (y-z) plane of the ramp.

14. The putting target according to claim 13, wherein the concaved surface is defined by a plurality of quadratic splines in an associated plane parallel to the longitudinal plane and the lateral plane of the ramp.

15. The putting target according to claim 8 further comprising an image applied to at least a portion of the ramp providing a perspective view of a golf hole along a predetermined line of sight.

16. The putting target according to claim 8 further comprising at least one rib extending between the ramp and the wall section beneath the concaved surface.

17. The putting target according to claim 16 further comprising a plurality of spikes extending from at least one of the bottom edge of the wall segment or a bottom edge of the rib.

18. A putting target comprising:

a target body formed with a first plastic material and configured to rest on a putting surface, the target body having a ramp including a concaved surface defined by at least one quadratic spline in each of a longitudinal (x-z) plane and a lateral (y-z) plane of the ramp, a rim circumscribing the concaved surface and an angled wall segment extending from the rim and terminating at a bottom edge for supporting the ramp at an inclined orientation with respect to the putting surface;

a lip establishing a leading edge of the target body and transitioning to the concaved surface formed on the ramp, the lip being formed with a second plastic material, wherein a hardness of the first plastic material is greater than a hardness of the second plastic material; and an image applied to at least a portion of the ramp providing a perspective view of a golf hole along a predetermined line of sight.

* * * * *